United States Patent [19]

Challet

[11] 3,963,411

[45] June 15, 1976

[54] PIEZOELECTRIC LIGHTERS NOTABLY FOR DOMESTIC APPLIANCE BURNERS AND THE LIKE

[75] Inventor: Jacques Challet, Le Puy, France

[73] Assignee: Constructions Electriques R.V., France

[22] Filed: Dec. 3, 1974

[21] Appl. No.: 529,041

[30] Foreign Application Priority Data

Dec. 7, 1973 France ..... 73.43829
Nov. 22, 1974 France ..... 74.38442

[52] U.S. Cl. ..... 431/255; 310/8; 126/39 E

[51] Int. Cl.[2] ..... F23Q 2/16; F23Q 7/06

[58] Field of Search ..... 431/255; 310/8, 8.1, 310/8.3, 9.1; 317/81

[56] References Cited

UNITED STATES PATENTS

| | | | |
|---|---|---|---|
| 3,434,790 | 3/1969 | Kanda | 431/255 |
| 3,768,959 | 10/1973 | Rohde et al. | 431/255 |
| 3,771,942 | 11/1973 | Sohnchen | 431/255 |
| 3,771,943 | 11/1973 | Schlamp | 431/255 |

FOREIGN PATENTS OR APPLICATIONS

| | | | |
|---|---|---|---|
| 1,554,247 | 12/1968 | France | 431/255 |

*Primary Examiner*—Kenneth W. Sprague
*Attorney, Agent, or Firm*—Larson, Taylor and Hinds

[57] ABSTRACT

A piezoelectric lighter for gas appliances, comprises a piezoelectric module adapted to be struck at one end. A case of insulating material contains the module of which the end opposite that receiving the impact is connected to an electrode emerging from the case. A hammer lever, also of insulating material, bears a percussion hammer, and pivots around an axle of the case on being subjected to the action of a spring. Electrical continuity is provided between the struck end and the metallic mass of the appliance on which the lighter is mounted.

14 Claims, 9 Drawing Figures

PIEZOELECTRIC LIGHTERS NOTABLY FOR DOMESTIC APPLIANCE BURNERS AND THE LIKE

The invention relates to piezoelectric lighters, and more especially to apparatuses of this type intended to ensure the lighting of burners, in particular gas burners, of domestic appliances or the like, being notably mounted on the frame of such equipment.

It is a particular object of the invention to provide simplification of these lighters, which, in known devices, generally include a large number of parts whose assembly necessitates much labour.

According to a main feature of the invention, there is provided in lighters of this type comprising a piezoelectric module adapted to be struck at one end, on the one hand, a case of insulating material containing said module of which the opposite end to that receiving the percussion is connected to an electrode emerging from the case, and on the other hand, a percussion lever, also of insulating material, bearing a percussion hammer, and adapted to pivot around an axle of said case by being subjected to the action of a spring, with lastly means for effecting electrical continuity between the first abovesaid end and the metallic mass of the appliance on which the lighter is mounted.

In a particular embodiment, the spring acting on the lever is wound around the axle of the latter.

Said spring may advantageously constitute the means for connecting electrically to the mass, the end of the piezoelectric module subjected to percussion, this spring being accordingly arranged so as to be supported, at one of its ends, on the percussion hammer, whilst at its other end, it is supported on a metallic fixing plate of the lighter.

In another embodiment, the operation of the lever is effected from a sudden release cam, operable by a handle whose shaft passes through the case.

In the latter case, another advantageous feature of the invention consists of using the shaft or the axle of said cam for the actuation of a burner valve or for any other operation.

Unidirectional drive means are then provided (pawl, free wheel, etc...) between the abovesaid cam and its shaft, so that, after actuation of the latter and release of the hammer of the lighter, it is possible to bring backwards again, if desired, the shaft and hence the valve to any intermediate position and also of course to the starting position for another actuation of the cam and of the lighter and so on.

The invention will, in any case, be well understood by means of the additional description which follows, as well as of the accompanying drawings, which description and drawings are of course given primarily by way of indication.

Figure 6:
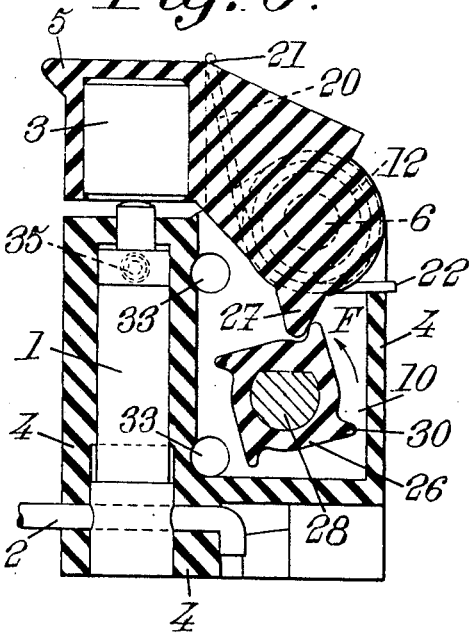
FIGS. 6 and 7 show respectively in cross section and in side view, with portions removed, another embodiment of a lighter constructed according to the invention.
Figure 8:
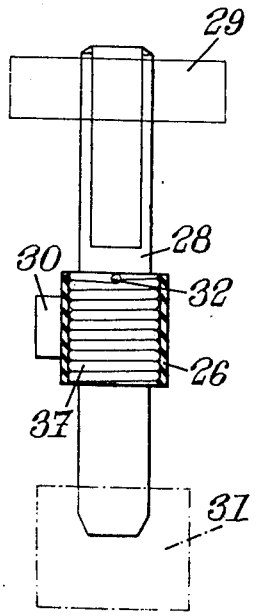
Figure 7:
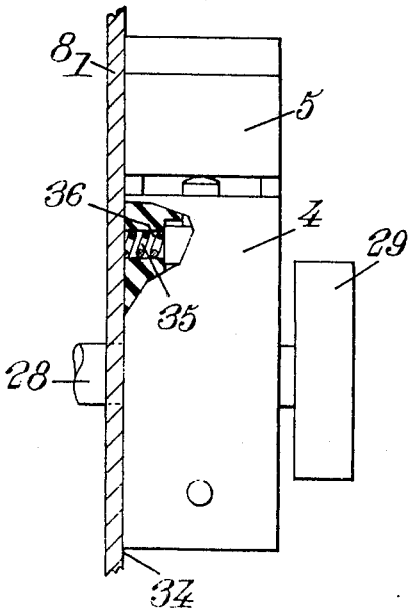
Figure 9:
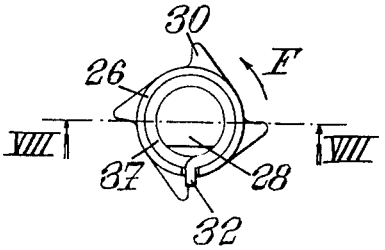

Lastly FIGS. 8 and 9 show respectively and separately, in sectional elevation through the line VIII—VIII of FIG. 9 and in cross section through the line IX—IX of FIG. 8, an actuating device which can be included in an assembly of the type shown in FIGS. 6 and 7, as a modification of the device according to the invention.

To follow the teachings of the invention and more especially those of its type of application, as well as those embodiments of its various parts, to which it appears that preference should be given, in order for example to construct a piezoelectric lighter for a gas burner of a domestic appliance or the like, procedure is as follows or in similar manner.

This appliance is made to comprise essentially, apart from its constituent members, that is to say apart from the piezoelectric module 1, with its electrode 2 and its hammer 3, on the one hand, a box of insulating plastics material 4, and on the other hand, a lever 5, preferably also of insulating plastics material, mounted in pivoting manner around an axle 6 of said case and subject to the action of a spring 20, the assembly being such that, said case being for example fixed to the body of the burner 7 or to a metallic part 8 fast to said body or to the domestic applicance or the like bearing the burner, the operation of the lighter is obtained by separating the lever against the action of its spring and by allowing it to fall back, the electrical continuity on the emission of the voltage pulse being effected by any suitable means, notably by the fact that, as will be described, the spring establishes a connection between the hammer 3 and the metallic part 8.

Figure 3:
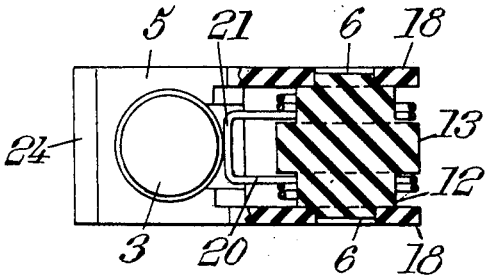
FIGS. 3 and 4 show respectively in section along the line III—III as shown in FIG. 4, and in vertical section on a larger scale with more details, an embodiment of a lighter according to the invention.
Figure 4:
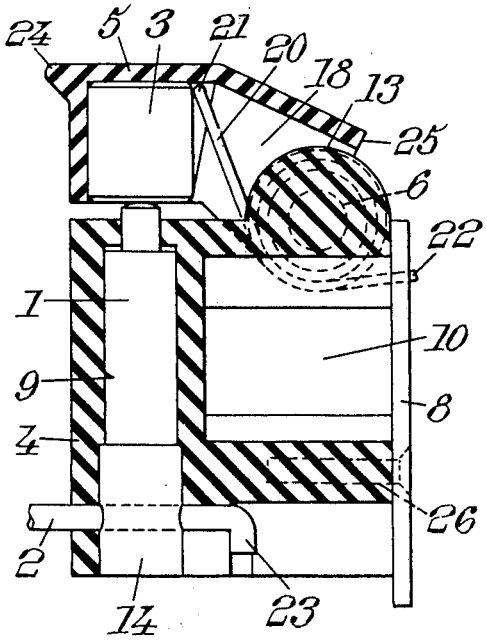
Figure 5:
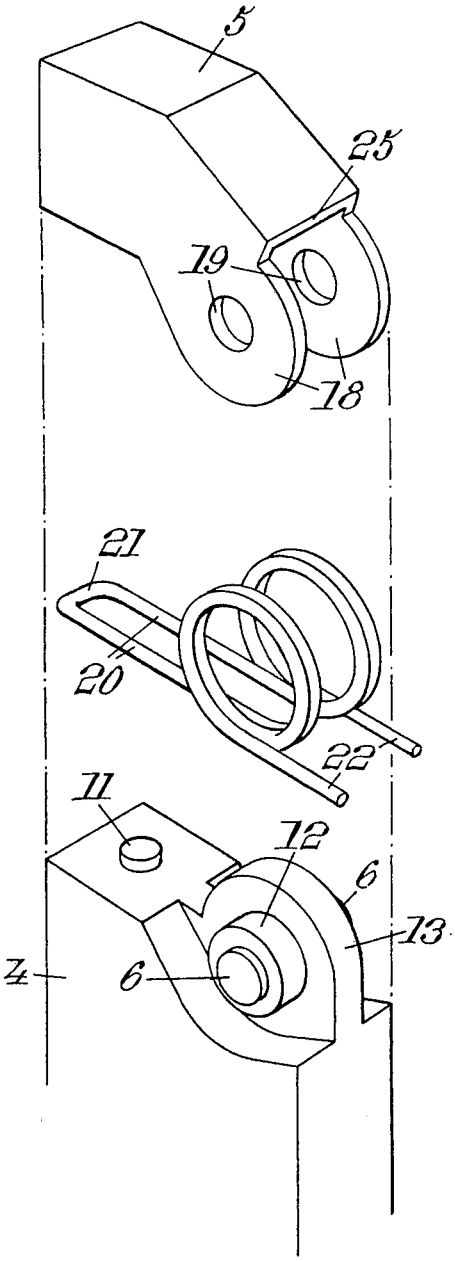
FIG. 5 shows separately in exploded view and in perspective certain elements of a lighter according to the invention.

Thus, as shown with more details in FIGS. 3 to 5, the case 4 takes for example a parallelopipedic form, with a housing 9 for the module 1 and a lightening cavity 10, and includes, on its wall disposed on the side of the striking pin 11 of the module to be struck by the hammer, a sort of drum 12 (FIGS. 3 and 5) separated into two parts by a rib 13 fast to said wall (said drum being fast to this rib or rotatable in the latter), which parts terminate in stub axles 6 for mounting the lever.

Figure 1:
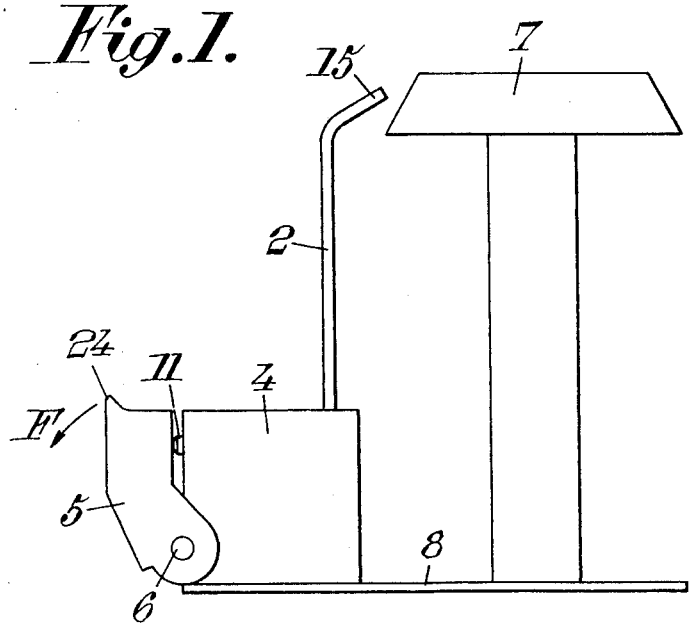
FIGS. 1 and 2 show, in two embodiments, the whole of a burner and of a lighter according to the invention.
Figure 2:
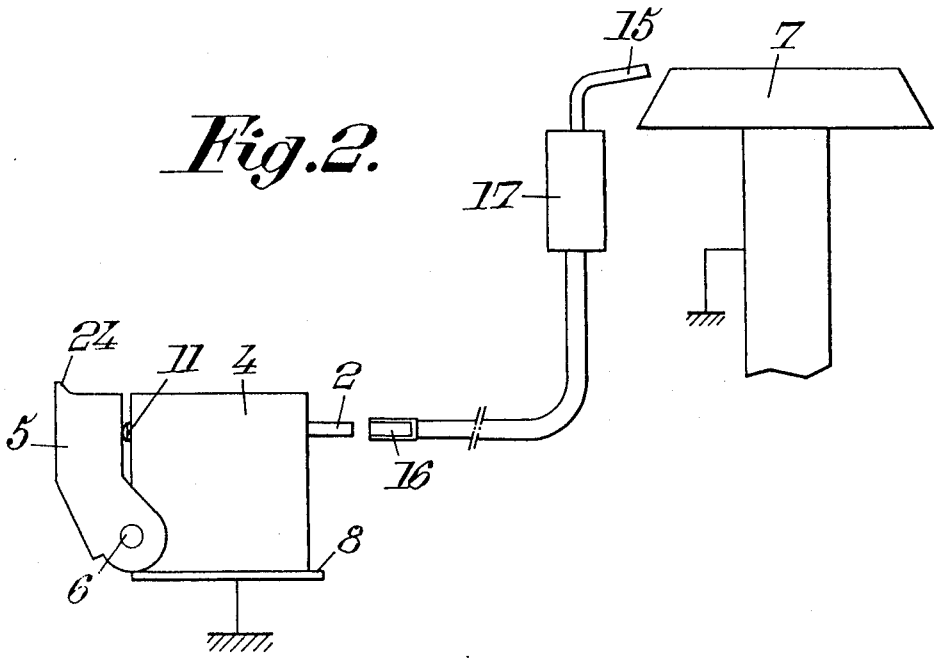

On the end 14 of the module opposite the striker 11 is fixed the electrode 2 which emerges in any suitable direction and which may for example, in the emobodiment shown for which the lighter is mounted on a burner applicance, either go directly to the burner, as shown in FIG. 1, with one end 15 suitably arranged close to the burner, or, when the distance between the lighter and the burner is greater, be connected through a suitable connector 16 to a plug device 17, as shown in FIG. 2.

The fixing of the electrode 2 on the case is done for example by clipping at 23 (FIGS. 3 and 4). The fixing of the case on the part 8 is done for example by screw 26.

On the case thus constructed, the lever 5 is mounted, hollow in form to receive the hammer 3, and having side plates 18 which are engaged by clipping on the axles 6 of the above-said drum. In other words, on mounting, the side plates 18 are elastically separated to cause the stub axles 6 to enter the holes 19 of said side plates.

Lastly, as regards the abovesaid spring 20, it is advantageously constituted by an elastic wire forming a loop 21 adapted to become supported against the hammer 3, whilst its arms are wound around the two half drums 12, to become finally, through their free ends 22 (FIGS. 3 and 5), fixed for example by fastening, on the metallic part such as 8. This part includes for example two holes traversed by said ends which are then curved.

The assembly thus obtained, for example fixed, by its metallic base 8, to the mass of a burner or of a domestic applicance, operates in the following manner.

For lighting, the operator presses his finger on the lever 5, advantageously including a projection 24 (FIGS. 1 to 5) to facilitate the grip, and he moves said lever until its rear edge 25 comes to a stop, then he releases it so that the lever falls back and the hammer strikes the module.

The high voltage is then generated and the spark flies from the burner at 15, due to the electrical continuity assured by the following circuit: electrode 2, module 1 and striker 11, hammer 3, spring 20, plate 8, mass of the domestic appliance or the like and burner.

There will now be described, with reference to FIGS. 6 to 9, other embodiments of the invention.

Firstly, in a first modification, instead of working the lever 5 directly with the finger, recourse is had to the effect of a cam such as 26 adapted to act for example on a nose 27 provided on the lever 5.

In the embodiment illustrated in these FIGS. 6 to 9, the cam 26, mounted inside a housing 10 of the case, on a shaft or axle 28 passing through the walls of said case, and actuated from a handle or the like 29, includes for example four lips 30 presented alternately at 90°, so that the angular separation of the shaft and of its handle, between two successive operations of the lighter, is 90°, it being understood that other solutions can be adopted.

The actuation of the handle 29, to make the shaft rotate (in the direction F, FIG. 6), through an angle sufficient for the lip 30 or one of the lips 30, to push the nose 27 and lift the lever 5 to allow it to fall subsequently and cause the impact, may be, either positive, the shaft 28 of the handle being keyed on the cam 26, as assumed in FIGS. 6 and 7, or arranged so as to ensure a unidirectional drive, that is to say that the handle and the shaft can, after rotation and lighting by percussion, be brought backwards to the starting position.

The latter solution, of which one embodiment has been illustrated in FIGS. 8 and 9 by way of example, enables simultaneous operation, from the handle such as 29, of any particular device and especially the valve of a burner intended to be lit by means of the lighter according to the invention, which valve has been represented very diagrammatically by the reference 31 in FIG. 8.

In the embodiment shown, the unidirectional drive is done by means of a helicoidal spring 37 with or without contiguous turns, wound with a certain elastic pressure on the shaft 28, for example by being housed in an annular gap left free between the shaft 28 and the cam 26, one of the ends 32 of the spring 37 being connected to the cam. The assembly is such that, for one direction of rotation F of the shaft, the spring tends to be gripped on the shaft hence to become fast with the latter, which results in driving of the cam, whilst, for the opposite direction, the spring tends to be released, hence to eliminate solidarisation with the shaft, which can turn freely and return to its starting position.

For a valve of the usual type, whose amplitude of rotation from the closed position to the open position is generally 90°, the preceding arrangement is quite satisfactory since, as is shown in the drawing (FIG. 6), the angle through which it must make the cam 26 rotate, to cause it to push the nose 27 of the lever 5, then to disengage it therefrom at the moment of release of said lever, may for example be of the order of 45°, notably comprised between 30° and 60°.

The assembly is completed by means for fixing the thus constructed lighter, against the corresponding wall $8_1$ of the applicance bearing the burner, these means consisting for example of screws (not shown) passing through orifices 33 of the case 4. The latter then becomes applied against the wall $8_1$ by one of its lateral faces 34 (FIG. 7).

Lastly, means are provided to ensure the continuity of the electrical circuit at the moment when the overvoltage is developed in the piezoelectric module. These means can come into play through the spring 20, if the latter is in contact with the hammer 3, as described with reference to FIGS. 1 to 5. However, other solutions may be adopted. For example, if the spring 20 is simply applied against the plastics material of the lever 5, as assumed in FIGS. 6 and 7, the abovesaid means consisting notably of a small spring 35 mounted in a housing 36 of the case 4 and adapted to come into contact, on one side, with the end of the module 1 facing the hammer 3, and on the other side, with the mass of the wall $8_1$, that is to say the mass of the domestic applicance or of the burner. The end of the electrode 4 being itself connected to a plug of the burner, it is hence between this plug and said mass that the spark will fly on percussion by the lever 5.

The functioning is then as follows.

Assuming the valve such as 31 in its closed position, the cam 36 is at this moment in a position such as the first lip 30 to be presented before the nose 27 of the lever is at an angular distance, with respect to the latter, of the order for example of 40° to 50°.

For lighting, the handle 29 must hence be turned in the direction F for driving the cam and opening the valve, which causes first, as soon as the cam touches the nose 27, at least partial opening of the valve. By continuing to turn, the lip 30 pushing the nose 27, there are operated at the same time, the end of the opening of the valve and, by actuation of the lever 5, the triggering of the lighter, hence its firing.

One is then free to make the handle 29 return backwards, to operate the adjustment of the valve and of the burner, whilst leaving thereby the cam in the position that it has reached. When it is desired to extinguish the burner, the handle is brought back to its starting position or closure of the valve, and the whole is ready to operate again for another lighting.

It is understood that the assembly could be such that the amplitude of the rotary movement of the handle is greater than 90°, for example 180° or 360°. The cam could have only one or two lips 30.

Any other drive means could be provided.

Such an assembly is particularly simple and inexpensive.

As is self evident, and as emerges already from the foregoing, the invention is no way limited to those of its types of application and embodiments, which have been more especially envisaged; it encompasses, on the contrary, all modifications.

I claim:

1. A piezoelectric lighter mountable on a domestic appliance burner or the like, particularly a gas appliance, of the type comprising a piezoelectric module adapted to receive an impact at one end thereof, said lighter comprising a case of insulating material containing said module, an electrode emerging from the case, the end of the module opposite that receiving the impact being connected to said electrode, a hammer lever of insulating material, a percussion hammer borne by said hammer lever, said hammer lever being adapted to pivot around an axle of said case, a spring arranged to cause the pivoting of said hammer lever, and means for providing electrical continuity between said one end of said module and the metallic mass of the applicance, said means for providing electrical continuity including said spring said spring being connected both to the metallic mass of the percussion hammer and to a metal plate for fixing the lighter to the applicance.

2. Lighter according to claim 1, wherein the spring has the general shape of a U supported on the hammer inside a hollow arm of the lever and whose arms, after being wound on a cylinder provided on the case and constituting the axle of the lever, become fixed by clipping on to the metallic plate for fixing the lighter on the applicance comprising the burner.

3. A piezoelectric lighter mountable on a domestic appliance burner or the like, particularly a gas appliance, of the type comprising a piezoelectric module adapted to receive an impact at one end thereof, said lighter comprising a case of insulating material containing said module, an electrode emerging from the case, the end of the module opposite that receiving the impact being connected to said electrode, a hammer lever of insulating material, a percussion hammer borne by said hammer lever, said hammer lever being adapted to pivot around an axle of said case, a spring arranged to cause the pivoting of said hammer lever, and means for providing electrical continuity between said one end of said module and the metallic mass of the appliance, said lighter further comprising a sudden release cam for the operation of said lever and a handle, whose shaft passes through the case, for operating said cam.

4. Lighter according to the claim 3, wherein the shaft of the handle actuates the cam positively.

5. Lighter according to claim 3, wherein the shaft of the handle drives the cam through unidirectional means.

6. Lighter according to claim 5, wherein the unidirectional means comprises a helicoidal spring wound with pressure on the actuating shaft, and connected by one end to said cam.

7. Lighter according to claim 6, wherein the helicoidal spring is housed in an annular space between shaft and cam.

8. Lighter according to claim 3, wherein the cam includes four lips at 90°, capable of acting one after the other on a nose included on the lever.

9. Lighter according to claim 8, wherein the driving zone of the cam up to the release of the lever is of the order of 30° to 60°.

10. Lighter according to claim 6, wherein the drive shaft of the cam serves also for driving a valve.

11. Lighter according to claim 10, wherein the driving of the cam, and of the lighter, from the close position of the valve comprises first a first angular travel in the course of which the valve is opened and the cam is approached by the part of the lever to be driven by the latter, then a second travel for driving and releasing the lever, after which the handle can be brought backward for the adjustment of the burner and, finally for return to the initial closed position.

12. A piezoelectric lighter mountable on a domestic applicance burner or the like, particularly a gas appliance, of the type comprising a piezoelectric module adapted to receive an impact at one end thereof, said lighter comprising a case of insulating material containing said module, an electrode emerging from the case, the end of the module opposite that receiving the impact being connected to said electrode, a hammer lever of insulating material, a percussion hammer borne by said hammer lever, said hammer lever being adapted to pivot around an axle of said case, a spring arranged to cause the pivoting of said hammer lever, and means for providing electrical continuity between said one end of said module and the metallic mass of the appliance, said means for providing electrical continuity including a further spring, which extends laterally of the piezoelectric module and engages, at one end thereof, the head of the module, and, at the other thereof, a metallic wall of the domestic appliance.

13. A piezoelectric lighter for a domestic appliance burner or the like, said lighter comprising, in combination; a case, fabricated of a plastic material and parallelepipedic in shape, adapted to be secured on one side thereof to the mass of the applicance, a piezoelectric module disposed within said case, one end of said module being connected to an electrode which projects from the case and extends to a burner, and the other end of said module being adapted to receive a percussive force, a striking lever, fabricated of an insulating material, for striking the other end of said module, means for mounting said striking lever so as to provide pivoting thereof about an axis of the case while the lever is being subjected to the action of a spring, said lever being disposed on the front side of the case and being operated by a user by drawing the lever outwardly toward the user and thereupon releasing the same, and means for providing electrical continuity between said one end of said module and the mass of the appliance.

14. Lighter according to claim 13, wherein the lever includes a lip to facilitate gripping.

* * * * *